US006526894B2

(12) United States Patent
Meindl

(10) Patent No.: US 6,526,894 B2
(45) Date of Patent: Mar. 4, 2003

(54) TRAVELING-GEAR MECHANISM FOR A TRANSPORT ASSEMBLY OF A CABLEWAY SYSTEM

(75) Inventor: Bernd Meindl, Hard (AT)

(73) Assignee: Innova Patent GmbH, Wolfurt (AT)

( * ) Notice: Subject to any disclaimer, the term of this patent is extended or adjusted under 35 U.S.C. 154(b) by 0 days.

(21) Appl. No.: 09/843,517

(22) Filed: Apr. 26, 2001

(65) Prior Publication Data

US 2002/0007761 A1 Jan. 24, 2002

(30) Foreign Application Priority Data

Jul. 20, 2000 (AT) ..... 1271/00

(51) Int. Cl.[7] ..... B61B 12/12

(52) U.S. Cl. ..... 104/229; 104/87; 104/112

(58) Field of Search ..... 104/87, 115, 112, 104/229, 139

(56) References Cited

U.S. PATENT DOCUMENTS 5,515,789 A * 5/1996 Brochand et al. ..... 104/173.1

* cited by examiner

*Primary Examiner*—S. Joseph Morano
*Assistant Examiner*—Robert J. McCarry, Jr.
(74) *Attorney, Agent, or Firm*—Laurence A. Greenberg; Werner H. Stemer; Ralph E. Locher

(57) ABSTRACT

A running-gear mechanism for the transport assembly of a cableway system has running rollers that roll in guide rails while the coupling assembly is uncoupled from the haulage cable. In the region of the running rollers there is provided at least one downwardly projecting continuation which projects into the guide rails.

7 Claims, 2 Drawing Sheets

TRAVELING-GEAR MECHANISM FOR A TRANSPORT ASSEMBLY OF A CABLEWAY SYSTEM

BACKGROUND OF THE INVENTION

FIELD OF THE INVENTION

The invention belongs to the mechanical arts and relates, more specifically, to a traveling-gear mechanism for a transport system of a cableway system. The mechanism is equipped with running rollers and with a coupling configuration.

Transport assemblies of prior art cableway systems are designed, on the one hand, with clamps, by means of which they can be clamped onto the haulage cable, and, on the other hand, with traveling-gear mechanisms, by means of which they can be moved along guide rails in the stations once the clamps have been opened. In such prior art cableway systems, the haulage cable is maintained at a running speed of approximately 8 m/sec. In the stations, the transport assembly is uncoupled from the haulage cable and moved through the station region along guide rails at such a speed that passengers can leave and/or board the corresponding transport device (e.g., gondola, cabin, lift chair, etc.).

It is known here for the running rollers to be produced from a metallic material. Such known running rollers, however, are disadvantageous because their movement along the guide rails, which are likewise produced from metal, causes very pronounced noise development. In order to keep the running noise to the lowest possible level, it is also known to produce the rollers of the running-gear mechanism from a plastic material. However, such running rollers have the disadvantage that they are at considerably greater risk of rupturing than is the case for running rollers produced from metal. If a running roller ruptures, this can cause serious disruption to operation. In particular, in the region where the transport assembly is coupled to the haulage cable, there is the risk of the haulage cable not being gripped by the clamps, as a result of which the transport assembly may crash downward as it leaves the station.

In order to eliminate this risk, it is known to provide additional guide rails, which are intended to ensure that the haulage cable is gripped by the clamps even if a running roller ruptures. These additional guide rails, however, do not meet the current requirements because they result in a further high level of design-related outlay and also because they do not ensure proper functioning of the clamps.

SUMMARY OF THE INVENTION

The object of the present invention is to provide a traveling-gear mechanism which overcomes the above-noted deficiencies and disadvantages of the prior art devices and methods of this general kind, and which clearly avoid the disadvantages of the prior art traveling-gear mechanisms.

With the above and other objects in view there is provided, in accordance with the invention, a running-gear mechanism for a transport assembly of a cableway system, comprising: running rollers configured to run in a guide rail, a coupling assembly for coupling the running-gear mechanism to a cable, and at least one downwardly projecting continuation disposed in a vicinity of the running rollers and configured to project into the guide rail.

In other words, the objects of the invention are achieved by providing, in the region of the running rollers, at least one downwardly projecting continuation which projects into the guide rails. In the case where a running roller ruptures, the continuation projecting into the guide rail assumes the function of a runner which slides in the guide rail, i.e., the projection "catches" the assembly, and then provides for the necessary emergency running properties during the coupling operation of the clamps.

In accordance with an added feature of the invention, the assembly is formed with a load-bearing member carrying the running rollers. In that case, the at least one continuation projects from the load-bearing member.

In accordance with an additional feature of the invention, the at least one continuation is disposed in a plane defined by the running rollers.

In accordance with another feature of the invention, there are provided a plurality of rollers. The at least one continuation is formed as two continuations disposed outside the two outer running rollers.

In accordance with again another feature of the invention, the two continuations are disposed to butt closely against the running rollers, and with a cross section decreasing in a direction away from the running rollers.

In accordance with a concomitant feature of the invention, the running rollers define a running surface at a given level, and the at least one continuation has a length such that a free end thereof terminates slightly above the given level.

In other words, there are preferably provided two continuations which are located outside the two outer running rollers of the traveling-gear mechanism. In this case, the two continuations may be arranged to butt closely against the running rollers, and they have a cross section which decreases in the direction away from the running rollers. In addition, the at least one continuation is preferably of such a length that its free end terminates slightly above the running surface of the running rollers.

Other features which are considered as characteristic for the invention are set forth in the appended claims.

Although the invention is illustrated and described herein as embodied in a traveling-gear mechanism for the transport assembly of a cableway system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
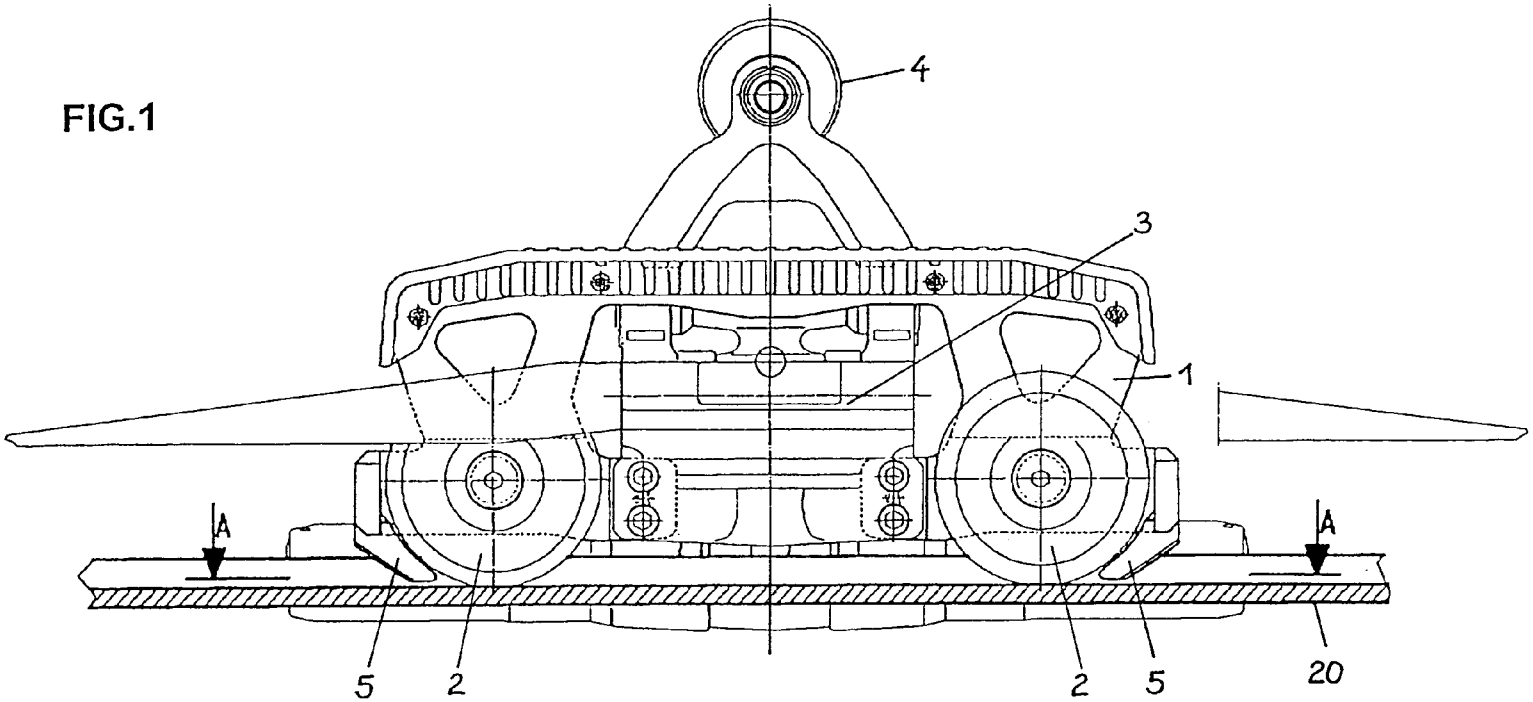
FIG. 1 is a side-elevational view of the traveling-gear mechanism of a transport assembly of a cableway system.

Referring now to the figures of the drawing in detail and first, particularly, to FIG. 1 thereof, there is seen a traveling-gear mechanism for a transport assembly, such as a cabin or a chair, of a cableway system. The traveling-gear mechanism comprises a load-bearing member 1 for two running rollers 2. Additionally provided on the traveling-gear mechanism are a clamping mechanism 3 and a control mechanism 4 which interacts therewith. Since these arrangements are known from the prior art, they will not be explained in any more detail. Reference may be had, for example, to European patent EP 621 163 B1 which describes a clamping and control mechanism of this general type. The running rollers 2, in the stations, are assigned guide rails 20, along which the transport assembly which have been uncoupled from the haulage cable are moved through the stations at such a speed that passengers can board and/or leave them.

The load-bearing member 1 for the running rollers 2 is designed with downwardly projecting continuations 5 which are located laterally outside the two running rollers 2. The continuations are arranged directly alongside the running rollers 2 and are of such a length that they terminate just slightly above the running surface of the guide rail 20.

The task of these continuations 5 is, in the case where a running roller 2 ruptures, to act as a runner in the guide rail 20. When the roller 2 ruptures, the continuation 5 assumes the function of the ruptured running roller so as to ensure the emergency running properties which are necessary for the coupling operation.

Figure 1A:
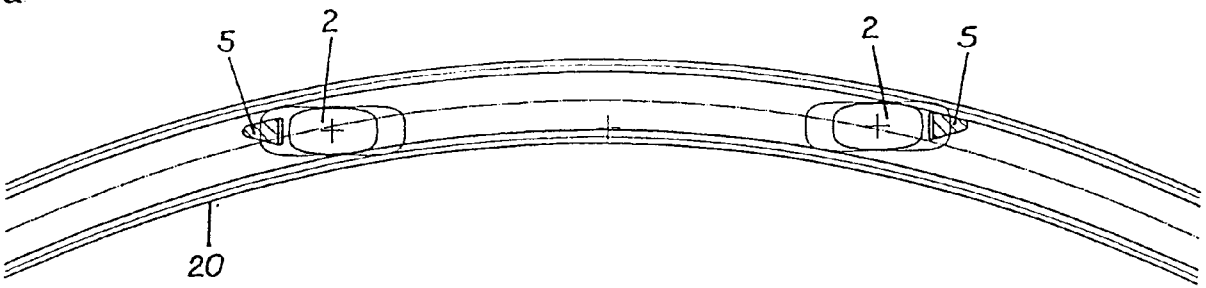
FIG. 1*a* is a sectional view of the traveling-gear mechanism taken along the line A—A in FIG. 1.

In order to fulfil this function, the continuations 5 have to project as far as possible in the guide rails 20. This ensures that, in the case of a running roller rupturing, the running-gear mechanism is retained in virtually the same vertical position as in the case of a fully functional running roller 2. In addition, the continuations 5 have to be of a width which is approximately equal to the width of the running rollers 2, in order thus also to ensure guidance in the necessary lateral position. Since, however, it is also necessary here to ensure the necessary ability of the running-gear mechanism to negotiate curves, the continuations 5 are of approximately triangular design in horizontal cross section. In this respect, reference is had to the illustration of FIG. 1*a*.

Figure 2B:
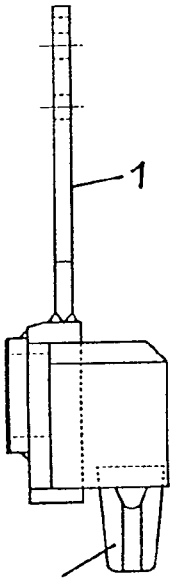
FIG. 2*b* is an end view of the load-bearing member.
Figure 2:
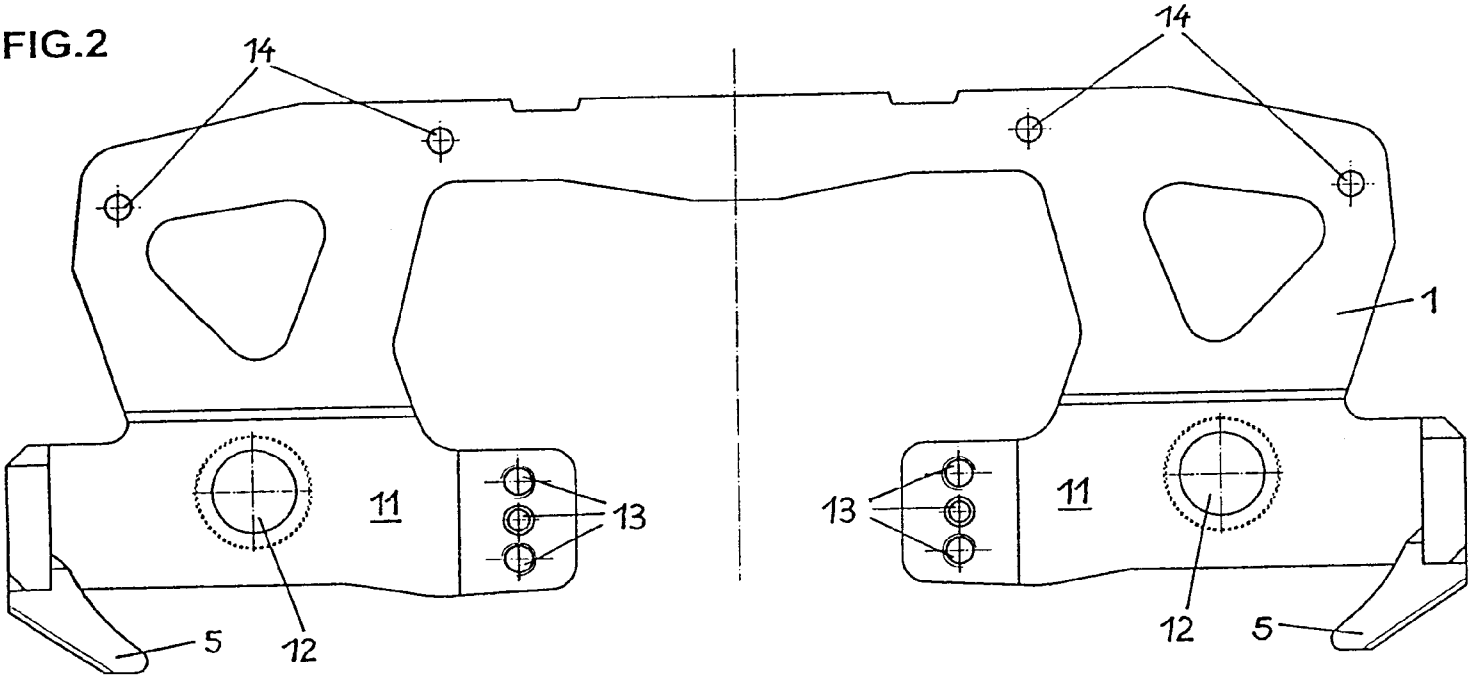
FIG. 2 is a side elevational view of a load-bearing member for the running rollers of the traveling-gear mechanism according to FIG. 1.
Figure 2A:
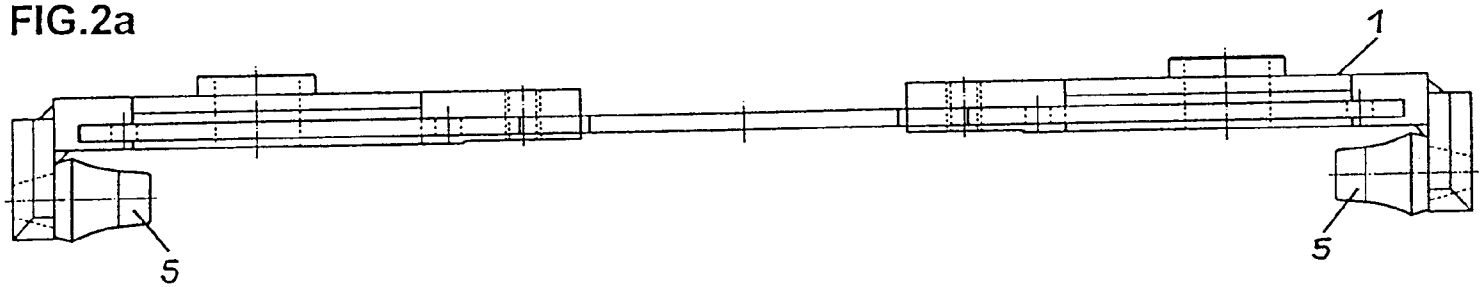
FIG. 2*a* is a plan view of the load-bearing member.

The load-bearing member 1, which is designed with continuations 5 and is intended for the running rollers 2, will be explained in more detail with reference to FIGS. 2, 2*a* and 2*b*. The load-bearing member 1, which is configured as an elongate component made of sheet steel, has two plates 11 which are formed with bores 12 into which it is possible to insert bolts for the running rollers 2. In addition, in the plane of the running rollers 2, it is designed with the two obliquely downwardly projecting continuations 5, which project into the guide rails. In the case where the associated running roller ruptures, the continuations 5 act as runners that slide in the guide rails. As a result of this the necessary emergency running properties are achieved. The load-bearing member 1 is also designed with bores 13, which serve for fastening the clamping assembly on the load-bearing member. In addition, it is formed with bores 14, which serve for fastening the friction surface against which the conveying wheels come into abutment.

I claim:

1. A running-gear mechanism for a transport assembly of a cableway system being formed, in a station thereof, with a guide rail along which the transport assembly is guided through the station, comprising:

a coupling assembly for coupling the running-gear mechanism to a cable, running rollers configured to run in the guide rail when the running-gear mechanism is uncoupled from the cable, and at least one downwardly projecting continuation disposed in a vicinity of said running rollers and configured to project into the guide rail, whereby said running-gear mechanism is supported on said downwardly projecting continuation in an emergency running mode if at least one of said running rollers malfunctions.

2. The running-gear mechanism according to claim 1, which comprises a load-bearing member carrying said running rollers, and wherein said at least one continuation projects from said load-bearing member.

3. The running-gear mechanism according to claim 1, wherein said at least one continuation is disposed in a plane defined by said running rollers.

4. The running-gear mechanism according to claim 1, wherein said running rollers are a plurality of rollers including two outer running rollers and said at least one continuation is one of two continuations disposed outside said two outer running rollers.

5. The running-gear mechanism according to claim 4, wherein said two continuations are disposed to butt closely against said running rollers, and with a cross section decreasing in a direction away from said running rollers.

6. The running-gear mechanism according to claim 1, wherein said running rollers define a running surface at a given level, and said at least one continuation has a length such that a free end thereof terminates slightly above the given level.

7. In a cableway system having an endless haulage cable supporting and driving a transport assembly, and at least one station in which the transport assembly is uncoupled from the haulage cable and guided through the station on a guide rail, a running-gear mechanism for the transport assembly, comprising:

a coupling assembly for coupling the running-gear mechanism to the haulage cable, running rollers configured to run in the guide rail when the running-gear mechanism is uncoupled from the cable, and at least one downwardly projecting continuation disposed in a vicinity of said running rollers and configured to project into the guide rail, whereby the running-gear mechanism is supported on said downwardly projecting continuation in an emergency running mode if at least one of said running rollers malfunctions.

* * * * *